US006359996B1

(12) United States Patent
Ohashi

(10) Patent No.: US 6,359,996 B1
(45) Date of Patent: Mar. 19, 2002

(54) SPEAKER DEVICE

(75) Inventor: Yoshio Ohashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/600,579

(22) PCT Filed: Nov. 18, 1999

(86) PCT No.: PCT/JP99/06438

§ 371 Date: Jul. 19, 2000

§ 102(e) Date: Jul. 19, 2000

(87) PCT Pub. No.: WO00/32012

PCT Pub. Date: Jun. 2, 2000

(30) Foreign Application Priority Data

Nov. 19, 1998 (JP) ..... 10-329649

(51) Int. Cl.[7] ..... H04R 25/00
(52) U.S. Cl. ..... 381/401; 381/402; 381/412
(58) Field of Search ..... 381/401, 402, 381/430, 398, FOR 154, FOR 155, FOR 159

(56) References Cited

U.S. PATENT DOCUMENTS

| | | | | | |
|---|---|---|---|---|---|
| 2,269,284 | A | * | 1/1942 | Olson | 381/402 |
| 2,727,949 | A | * | 12/1955 | Lokkesmoe | 381/402 |
| 2,922,849 | A | * | 1/1960 | Uchida | 381/401 |
| 5,150,419 | A | * | 9/1992 | Kizak et al. | 381/194 |

* cited by examiner

*Primary Examiner*—Sinh Tran
(74) *Attorney, Agent, or Firm*—Jay H. Maioli

(57) ABSTRACT

A speaker apparatus has a magnetic circuit portion, a diaphragm, a secondary coil, at least one primary coil, a cylindrical member, and a positioning portion. The magnetic circuit portion has a magnet, a yoke for which the magnet is provided, and a top plate for forming a magnetic gap together with the yoke. The primary coil is arranged in the magnetic gap of the magnetic circuit portion. The secondary coil is provided for the diaphragm so as to face the primary coil in the magnetic gap. One side of the cylindrical member locating in the magnetic gap is attached to the primary coil, and the cylindrical member supplies a current to the primary coil. The positioning portion is provided for a yoke and positions the other side of the cylindrical member.

12 Claims, 10 Drawing Sheets

SPEAKER DEVICE

TECHNICAL FIELD

The invention relates to a speaker apparatus and, more particularly, to a speaker apparatus having a primary coil and a secondary coil.

BACKGROUND ART

Hitherto, an electromagnetic induction speaker has been known. As such a speaker, there are what is called an inner magnetic type electromagnetic induction speaker in which a magnet is arranged inside and what is called an outer magnetic type electromagnetic induction speaker in which a magnet is arranged outside.

As shown in FIG. 1, an inner magnetic type electromagnetic induction speaker 100 has a yoke 110, a magnet 120, and a diaphragm 130.

The yoke 110 is constructed by integratedly forming: a disk-shaped bottom portion 111; a peripheral wall portion 112 projected upward from a peripheral edge of the bottom portion 111; and a ring-shaped annular plate 113 provided at the upper edge of the peripheral wall portion 112. The cylindrical magnet 120 is attached to the center portion of the upper surface of the bottom portion 111. The upper surface of the annular plate 113 of the yoke 110 is attached to a frame 140.

A disk-shaped center plate 150 is attached to the upper surface of the magnet 120. The center plate 150 is arranged in a center hole 113*a* of the annular plate 113. A gap formed between the annular plate 113 and center plate 150 is a magnetic gap 160.

The diaphragm 130 is constructed by integratedly forming: an almost semispherical dome portion 131 provided in the center portion; and an edge portion 132 having a small arc-shaped cross section and formed so as to be continuous with the outer periphery of the dome portion 131. An outer edge portion of the edge portion 132 is attached to the upper surface of the frame 140. An upper edge of a cylindrical bobbin 170 is fixed to the outer peripheral edge of the dome portion 131 by adhesion or the like.

A secondary coil 171 of one turn is wound around a portion near the lower edge of the bobbin 170 and fixed. The secondary coil 171 is located in the magnetic gap 160 formed between the annular plate 113 and center plate 150.

A primary coil 180 on the outer peripheral side and a primary coil 190 on the inner peripheral side are arranged in the magnetic gap 160 so as to face each other through the secondary coil 171. The outer peripheral side primary coil 180 is fixed to the inner peripheral surface of the annular plate 113 of the yoke 110. The inner peripheral side primary coil 190 is fixed to the outer peripheral surface of the center plate 150. The outer peripheral side primary coil 180 and inner peripheral side primary coil 190 are serially connected. One end of the outer peripheral side primary coil 180 is connected to a signal lead wire 180*a*. One end of the inner peripheral side primary coil 190 is connected to a signal lead wire 190*a*.

When a current based on an audio signal which is supplied from an audio signal reproducing unit (not shown) is supplied to the outer peripheral side primary coil 180 and inner peripheral side primary coil 190, an induction current flows in the secondary coil 171 arranged in the magnetic gap 160. The diaphragm 130 is vibrated by a Lorentz force. The audible sound based on the audio signal corresponding to the current supplied to the primary coil 190 is generated.

As shown in FIG. 2, an outer magnetic type speaker 200 comprises a yoke 210, a magnet 220, and a diaphragm 230.

The yoke 210 is constructed by integratedly forming: a disk-shaped bottom portion 211; and a center pole 212 projected upward from the center portion of the bottom portion 211. The cylindrical magnet 220 is attached to an outer edge portion of the upper surface of the bottom portion 211.

A ring-shaped annular plate 240 is attached to the upper surface of the magnet 220. The annular plate 240 is arranged in correspondence to the upper edge portion of the center pole 212. An upper surface of the outer edge portion of the annular plate 240 is attached to a frame 250. A gap formed between the annular plate 240 and center pole 212 is a magnetic gap 260.

The diaphragm 230 comprises: a center portion 231 having an arc-shaped cross section and locating in the center portion; an inclined portion 232 which is provided so as to be continuous with the outer periphery of the center portion 231 and deviated upward as it approaches the outward position; an edge portion 233 which is continuous with the outer periphery of the inclined portion 232; and a fixing portion 234 which is provided so as to be continuous with the outer periphery of the center portion 231 and is projected in the direction opposite to the inclined portion 232. An outer edge portion of the edge portion 233 is attached to the upper surface of the outer edge portion of the frame 250. An upper edge portion of a cylindrical bobbin 270 is fixed to an edge portion of the fixing portion 234 by adhesion or the like.

A secondary coil 271 of one turn is wound around a portion near the lower edge of the bobbin 270 and fixed. The secondary coil 271 is located in the magnetic gap 260 formed between the annular plate 240 and center pole 212.

A primary coil 280 on the outer peripheral side and a primary coil 290 on the inner peripheral side are arranged in the magnetic gap 260 so as to face each other through the secondary coil 271. The outer peripheral side primary coil 280 is fixed to the inner peripheral surface of the annular plate 240. The inner peripheral side primary coil 290 is fixed to the upper edge portion of the outer peripheral surface of the center pole 212. The outer peripheral side primary coil 280 and inner peripheral side primary coil 290 are serially connected. One end of the outer peripheral side primary coil 280 is connected to a signal lead wire 280*a*. One end of the inner peripheral side primary coil 290 is connected to a signal lead wire 290*a*.

When a current based on an audio signal which is supplied from an audio signal reproducing unit (not shown) is supplied to the outer peripheral side primary coil 280 and inner peripheral side primary coil 290 in a manner similar to the speaker 100 shown in FIG. 1 mentioned above, an induction current flows in the secondary coil 271 arranged in the magnetic gap 260. The diaphragm 230 is vibrated by a Lorentz force. The audible sound based on the audio signal corresponding to the supplied current is generated.

When the primary coils 180, 190, 280, and 290 mentioned above are fixed to the annular plates 113 and 240 or the center plate 150 or center pole 212, there are generally the following two methods.

(1) In a state where the primary coils 180, 190, 280, and 290 are wound and fixed to the outer peripheral surface of the cylindrical bobbin (not shown), they are internally fitted to the annular plates 113 and 240 or externally fitted to the center plate 150 or center pole 212 and fixed by adhesion or the like.

(2) In a state where the primary coils 180, 190, 280, and 290 are wound without using any bobbin (they are formed as bobbinless coils), they are internally fitted to the annular plates 113 and 240 or externally fitted to the center plate 150 or center pole 212 and fixed by adhesion or the like.

Generally, the foregoing bobbins and the primary coils 180, 190, 280, and 290 which are internally fitted to the annular plates 113 and 240 or externally fitted to the center plate 150 or center pole 212 are very thin and their mechanical strengths are weak. Therefore, when they are internally fitted to the annular plates 113 and 240 or externally fitted to the center plate 150 or center pole 212, it is necessary to prevent the occurrence of damage or the like by constructing them in such a manner that the bobbins and the primary coils 180, 190, 280, and 290 are not come into contact with the annular plates 113 and 240, center plate 150, and center pole 212.

Therefore, even by any of the foregoing methods, in a state where the primary coils 180 and 280 are previously wound, their outer diameters are set to be slightly smaller than inner diameters of the annular plates 113 and 240, and the adhesive agent is filled in the gaps between the primary coils 180 and 280 and the annular plates 113 and 240 to thereby fix them. In a state where the primary coils 190 and 290 are previously wound, their inner diameters are set to be slightly larger than outer diameter of the center plate 150 or center pole 212, and the adhesive agent is filled in the gap between the primary coils 190 and 290 and the center plate 150 or center pole 212 to thereby fix them.

However, since all of the annular plates 113 and 240, center plate 150, and center pole 212 are thin, there is a problem that an area of each peripheral surface is small and adhesive strengths between the primary coils 180, 190, 280, and 290 and the annular plates 113 and 240 and the center plate 150 or center pole 212 are weak.

Generally, in the inner magnetic type electromagnetic induction speaker 100 shown in FIG. 1, after the inner peripheral side primary coil 190 is fixed to the center plate 150, the center plate 150 is fixed to the magnet 120 attached to the yoke 110 in a state where it has been positioned. In the outer magnetic type electromagnetic induction speaker 200 shown in FIG. 2, after the outer peripheral side primary coil 280 is fixed to the annular plate 240, the annular plate 240 is fixed to the magnet 220 attached to the yoke 210 in a state where it has been positioned.

When the operation to fix the annular plate 240 to the magnet 220 is performed, in order to keep predetermined gap intervals of the magnetic gaps 160 and 260, a gap gauge is inserted between the outer peripheral side primary coil 180 and inner peripheral side primary coil 190 or between the outer peripheral side primary coil 280 and inner peripheral side primary coil 290 and the gap interval is adjusted so as to be constant, thereby positioning each member. If the gap gauge is come into contact with the primary coil 180, 190, 280, or 290 at the time of the positioning operation, since the adhesive strength is weak, there is a fear that the primary coil 180, 190, 280, or 290 is dropped out from the annular plates 113 and 240, center plate 150, or center pole 212.

DISCLOSURE OF INVENTION

It is an object of a speaker apparatus of the invention to solve the foregoing problems, enable a primary coil to be easily positioned, and improve an attaching strength of the primary coil.

According to Claim 1, there is provided a speaker apparatus comprising:

a magnetic circuit portion having a magnet, a yoke for which the magnet is provided, and a top plate for forming a magnetic gap together with the yoke;

at least one primary coil arranged in the magnetic gap of the magnetic circuit portion;

a diaphragm;

a secondary coil provided for the diaphragm so as to face the primary coil in the magnetic gap;

a cylindrical member in which one side locating in the magnetic gap is attached to the primary coil and which supplies a current to the primary coil; and a positioning portion, provided for the yoke, for positioning the other side of the cylindrical member.

In the speaker apparatus according to Claim 1, there is no need to use a gap gauge in order to obtain a predetermined gap interval of the magnetic gap, and an attaching area of the primary coil increases.

BEST MODE FOR CARRYING OUT THE INVENTION

Figure 1:
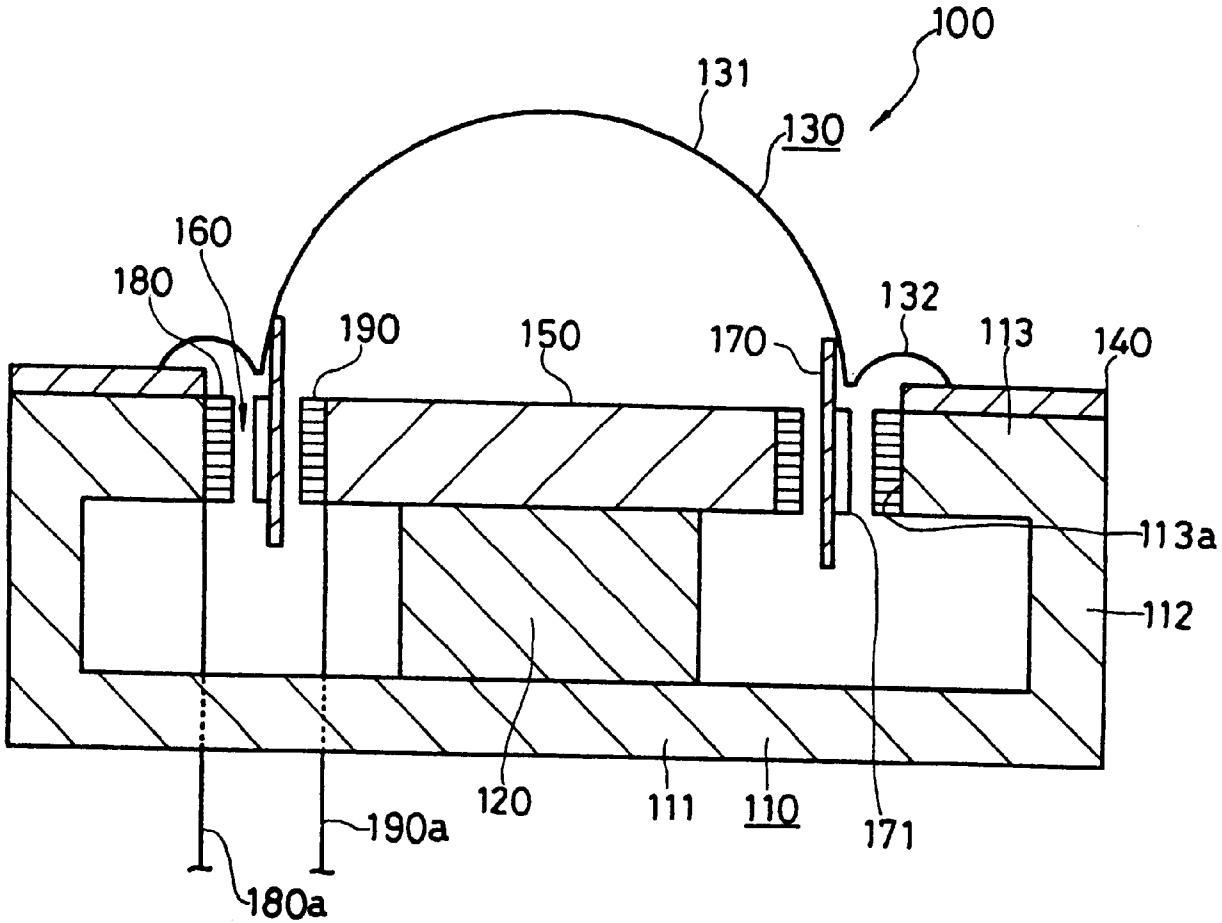
FIG. 1 is a schematic vertical sectional view showing a conventional inner magnetic type electromagnetic induction speaker.
Figure 2:
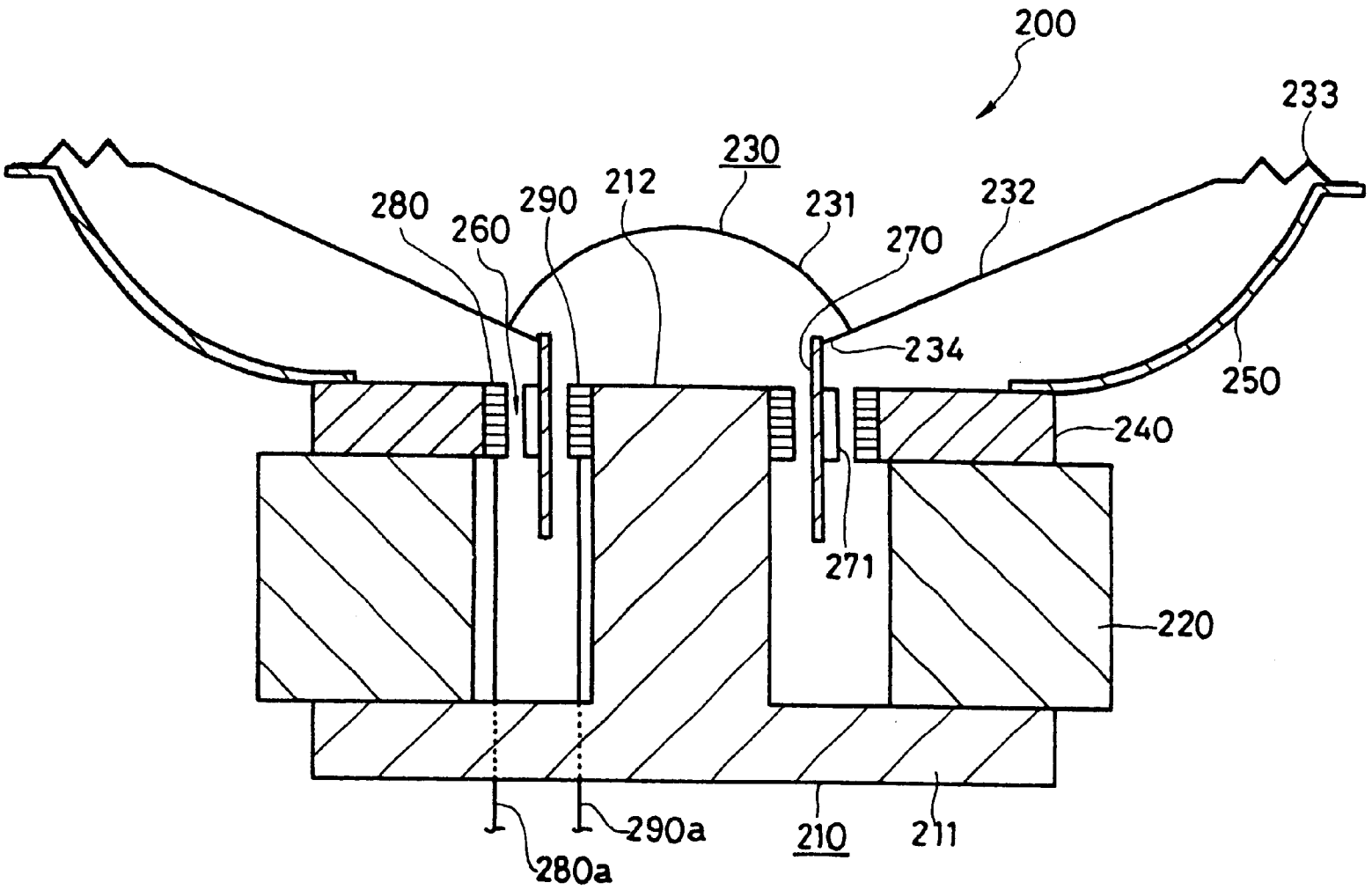
FIG. 2 is a schematic vertical sectional view showing a conventional outer magnetic type electromagnetic induction speaker.

Each embodiment of a speaker apparatus of the invention will now be described hereinbelow with reference to the drawings.

In the embodiments shown below, the invention is applied to an electromagnetic induction speaker.

First, an inner magnetic type electromagnetic induction speaker 1 shown in FIG. 3 will now be described as a first embodiment.

The inner magnetic type electromagnetic induction speaker 1 comprises a yoke 2, a magnet 3, and a diaphragm 4.

The yoke 2 is constructed by integrating an almost disk-shaped bottom portion 5, a peripheral wall portion 6 upwardly projecting from a peripheral edge of the bottom portion 5, and a ring-shaped annular plate 7 provided on an upper edge of the peripheral wall portion 6. A positioning portion 8 is formed on an upper surface of a center portion of the bottom portion 5.

The positioning portion 8 is formed in a stairway shape from the bottom portion 5 of the yoke 2 when it is seen as a vertical sectional shape, and a first stairway portion 9 and a second stairway portion 10 are formed integratedly with the bottom portion 5. The first stairway portion 9 is formed in a disk-shape, its outer peripheral portion 9*a* is used as a first stairway surface, and its upper surface 9*b* is positioned slightly upward from the upper surface of the bottom portion 5. The second stairway portion 10 is formed in a disk shape fairly smaller than the first stairway portion 9 and provided coaxially with the first stairway portion 9. An outer peripheral surface 10*a* is formed as a second stairway surface and an upper surface 10*b* is positioned slightly upward from the upper surface 9*b* of the first stairway portion 9.

The cylindrical magnet 3 is attached to the center portion of the upper surface 10*b* of the second stairway portion 10. For example, the magnet 3 is arranged in a positioning concave portion (not shown) formed on the upper surface 10*b* of the second stairway portion 10, so that the magnet is arranged coaxially with the second stairway portion 10.

As for the yoke 2, the upper surface of the annular plate 7 is attached to a frame 11. The inner peripheral surface of the annular plate 7 is located slightly on the outer side from the first stairway surface 9*a* of the first stairway portion 9, while the center axis of the positioning portion 8 is used as a reference.

A disk-shaped center plate 12 serving as a top plate is attached to the upper surface of the magnet 3. The center plate 12 is arranged in a center hole 7*a* of the annular plate 7. The peripheral surface of the center plate 12 is located at the same phase as that of the second stairway surface 10*a* of the second stairway portion 10, while the center axis of the positioning portion 8 is used as a reference. A gap formed between the annular plate 7 and center plate 12 becomes a magnetic gap 13. A magnetic circuit portion is constructed by the yoke 2, magnet 3, annular plate 7, and center plate 12.

The whole diaphragm 4 is formed in a dome shape. The diaphragm 4 is constructed by integratedly forming an almost semispherical dome portion 4*a* locating in the center portion and an edge portion 4*b* having a small almost arc-shaped cross section and provided so as to be continuous with an outer periphery of the dome portion 4*a*. The outer edge portion of the edge portion 4*b* is attached to the upper surface of the frame 11. The upper edge portion of a cylindrical bobbin 14 is fixed to the outer peripheral edge of the inner surface of the dome portion 4*a* by adhesion or the like. The diaphragm 4 and bobbin 14 can be fixedly adhered by a method, which will be explained hereinlater.

A secondary coil 15 of one turn is wound around the portion (near the lower edge) of the bobbin 14 and fixed. The secondary coil 15 is positioned in the magnetic gap 13 formed between the annular plate 7 and center plate 12.

A primary coil 16 on the outer peripheral side and a primary coil 17 on the inner peripheral side are arranged in the magnetic gap 13 so as to face each other through the secondary coil 15. The outer peripheral side primary coil 16 and inner peripheral side primary coil 17 are serially connected. One end of the outer peripheral side primary coil 16 and one end of the inner peripheral side primary coil 17 are connected to signal lead wires 16*a* and 17*a* to which an audio signal from an audio signal reproducing unit (not shown) is supplied, respectively.

The outer peripheral side primary coil 16 is wound around the outer periphery of the upper edge portion of a first cylindrical member 18 having a thin cylindrical shape and fixed. The first cylindrical member 18 is formed so that its inner diameter is equal to the outer diameter of the first stairway portion 9. The inner surface of the lower edge portion of the first cylindrical member 18 is adhered to the first stairway surface 9*a* of the first stairway portion 9 of the positioning portion 8. The outer peripheral surface of the outer peripheral side primary coil 16 fixed to the first cylindrical member 18 is adhered to the inner peripheral surface of the annular plate 7.

The outer peripheral side primary coil 16 fixed to the first cylindrical member 18 is fixed to the yoke 2, for example, by a method whereby the first cylindrical member 18 is inserted from the upper position into the yoke 2, the lower edge portion of the first cylindrical member 18 is adhered to the first stairway surface 9*a,* and the outer peripheral surface of the outer peripheral side primary coil 16 is adhered to the inner peripheral surface of the annular plate 7.

The inner peripheral side primary coil 17 is wound around the outer periphery of the upper edge portion of a second cylindrical member 19 having a thin cylindrical shape and fixed. The second cylindrical member 19 is formed so that its inner diameter is equal to the outer diameter of the second stairway portion 10. An inner surface of a lower edge portion of the second cylindrical member 19 is adhered to the second stairway surface 10*a* of the second stairway portion 10 of the positioning portion 8. An inner peripheral surface of an upper edge portion of the second cylindrical member 19 is adhered to the outer peripheral surface of the center plate 12.

The inner peripheral side primary coil 17 fixed to the second cylindrical member 19 is fixed to the yoke 2, for example, by a method whereby the second cylindrical member 19 is preliminarily and externally fitted to the center plate 12, the inner surface of the upper edge portion of the second cylindrical member 19 is adhered to the center plate 12, and in a state where the second cylindrical member 19 has been fixed to the center plate 12, the second cylindrical member 19 is inserted into the yoke 2 from the upper position of the yoke 2 together with the center plate 12, and the lower edge portion of the second cylindrical member 19 is adhered to the second stairway surface 10*a*. By externally fitting the second cylindrical member 19 to the second stairway portion 10 of the positioning portion 8, the positioning of the inner peripheral side primary coil 17 to the yoke 2 is performed, so that the positioning of the center plate 12 to the magnet 3 attached to the yoke 2 is also simultaneously performed. The center plate 12 is fixed to the magnet 3 by using proper means such as adhesion, screwing, or the like.

Figure 3:
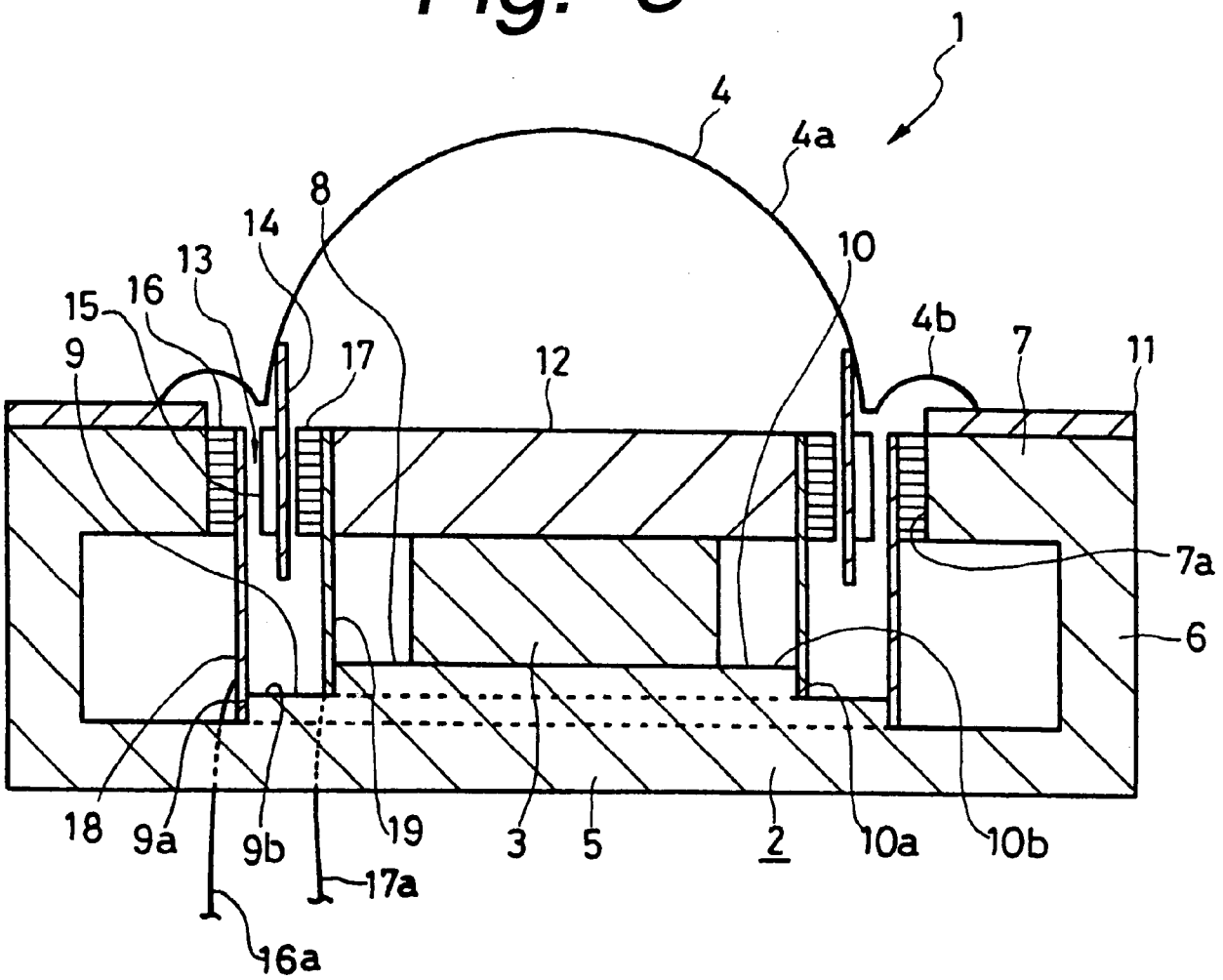
FIG. 3 is a schematic vertical sectional view showing the first embodiment in which a speaker apparatus of the invention is applied to an inner magnetic type electromagnetic induction speaker.

As mentioned above, in the inner magnetic type electromagnetic induction speaker 1 shown in FIG. 3, the positioning portion 8 is formed on the yoke 2, and the first cylindrical member 18 to which the outer peripheral side primary coil 16 has been fixed and the second cylindrical member 19 to which the inner peripheral side primary coil 17 has been fixed are merely externally fitted to the first stairway portion 9 and second stairway portion 10 of the positioning portion 8, respectively, so that the positioning of the outer peripheral side primary coil 16 and inner peripheral side primary coil 17 to the yoke 2 can be performed.

Therefore, since the positioning of the outer peripheral side primary coil 16 and inner peripheral side primary coil 17 to the yoke 2 can be extremely easily performed and there is no need to use the gap gauge, there is no fear of dropout (the conventional problem mentioned above) from the yoke 2 or the like due to the contact of the gap gauge with the outer peripheral side primary coil 16 or inner peripheral side primary coil 17.

The first cylindrical member 18 is adhered to the first stairway surface 9*a* of the positioning portion 8, the outer peripheral side primary coil 16 fixed to the first cylindrical member 18 is adhered to the annular plate 7, and the second cylindrical member 19 is adhered to the second stairway surface 10*a* of the positioning portion 8 and adhered to the center plate 12, so that the number of adhering portions increases. Consequently, an adhering area increases and an adhering strength of the outer peripheral side primary coil 16 and inner peripheral side primary coil 17 is improved.

As for the positioning portion 8, it is sufficient to merely form the two stairway portions 9 and 10 to the bottom portion 5 of the yoke 2 and the positioning portion 8 can be easily formed.

In the foregoing positioning portion 8, although the stairway portions 9 and 10 are formed so that the center portion of the yoke 2 is located at the highest position, the positioning portion can be also provided by forming a concave portion in such a manner that the bottom surface is deformed downward step by step so that the center portion of the yoke 2 is located at the lowest position.

Figure 4:
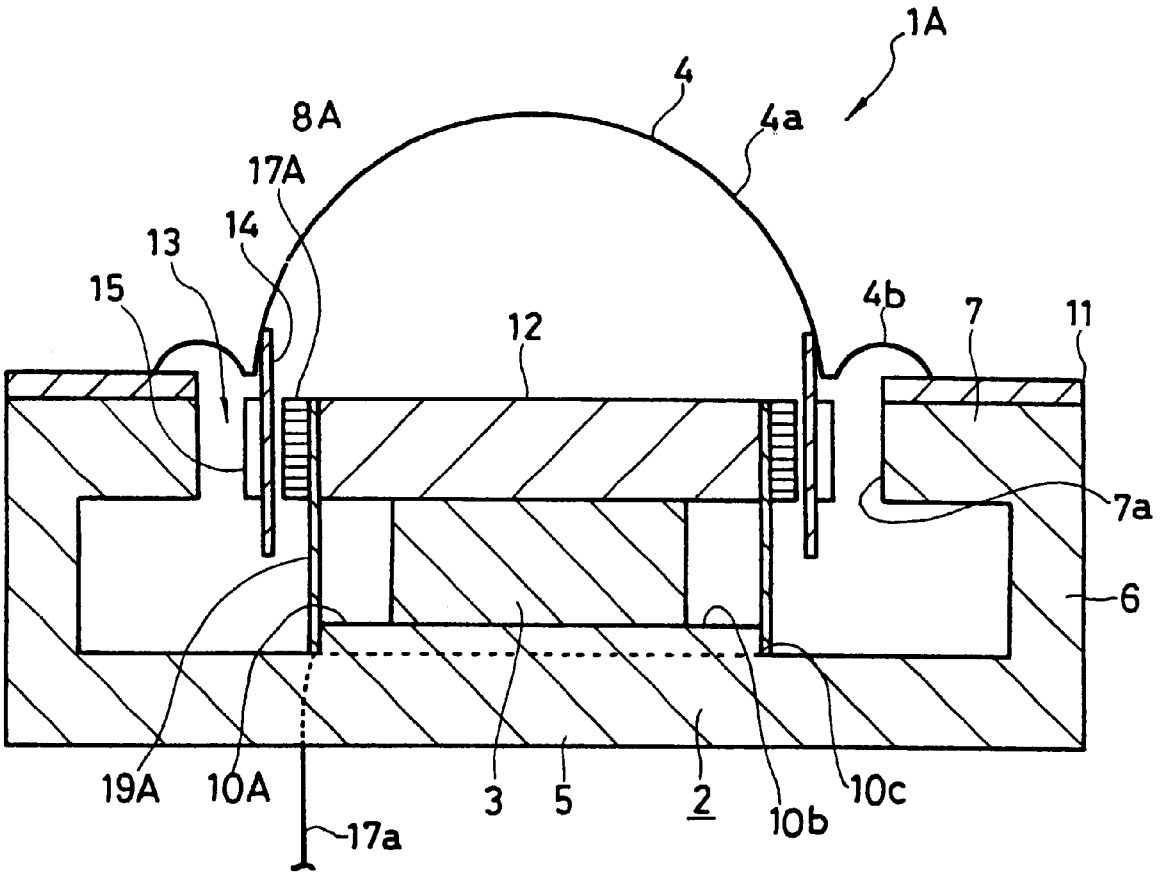
FIG. 4 is a schematic vertical sectional view showing an inner magnetic type electromagnetic induction speaker in which a primary coil is arranged only on one side of a secondary coil.

According to the inner magnetic type electromagnetic induction speaker 1 shown in FIG. 3, the primary coils are arranged so as to face each other through the secondary coil. However, the invention can be also applied to an inner magnetic type electromagnetic induction speaker 1A as shown in FIG. 4 in which the primary coil is arranged only on one side of a secondary coil.

As compared with the inner magnetic type electromagnetic induction speaker 1 shown in FIG. 3, the inner magnetic type electromagnetic induction speaker 1A shown below merely differs from the speaker 1 with respect to a point that a primary coil is arranged only on one side of a secondary coil and only one stairway portion is provided as a positioning portion in correspondence thereto. In an explanation of the inner magnetic type electromagnetic induction speaker 1A, only different portions from those of the inner magnetic type electromagnetic induction speaker 1 will be described in detail. The other portions are designated by the same reference numerals as those shown in the similar portions in the inner magnetic type electromagnetic induction speaker 1 and their descriptions are omitted.

As for a positioning portion 8A, a disk-shaped stairway portion 10A is formed and its outer peripheral surface 10*c* becomes a stairway surface.

A primary coil 17A is arranged in the magnetic gap 13 at a position between the secondary coil 15 and center plate 12. The primary coil 17A is connected to the signal lead wire 17*a* to which an audio signal from an audio signal reproducing unit (not shown) is supplied.

The primary coil 17A is wound around an outer periphery of an upper edge portion of a cylindrical member 19A having a thin cylindrical shape and fixed. The cylindrical member 19A is formed so that its inner diameter is equal to an outer diameter of the stairway portion 10A. An inner surface of a lower edge portion of the cylindrical member 19A is adhered to the stairway surface 10*c* of the stairway portion 10A of the positioning portion 8A. An inner peripheral surface of an upper edge portion of the cylindrical member 19A is adhered to the outer peripheral surface of the center plate 12.

The primary coil 17A fixed to the cylindrical member 19A is fixed to the yoke 2, for example, by a method whereby the cylindrical member 19A is preliminarily and externally fitted to the center plate 12, an inner surface of an upper edge portion of the cylindrical member 19A is adhered to the center plate 12, and in a state where the cylindrical member is fixed to the center plate 12, the cylindrical member 19A is inserted into the yoke 2 from the upper position of the yoke 2 together with the center plate 12, the lower edge portion of the cylindrical member 19A is adhered to the second stairway surface 10*c*, and the center plate 12 is fixed to the magnet 3 by an adhesion or the like.

Even in a speaker in which the primary coil 17A is arranged only on one side of the secondary coil 15 like an inner magnetic type electromagnetic induction speaker 1A, the positioning of the primary coil 17A to the yoke 2 can be extremely easily performed.

Although the positioning portion 8A has been provided as a stairway portion 10A, it is also possible to form the positioning portion 8A as a concave portion and adhere an outer peripheral surface of the lower edge portion of the cylindrical member 19A to the periphery of the concave portion.

In case of the foregoing inner magnetic type electromagnetic induction speaker 1A, although the primary coil 17A has been arranged in the magnetic gap 13 at the position between the secondary coil 15 and center plate 12, the primary coil can be also arranged in the magnetic gap 13 at a position between the secondary coil 15 and annular plate 7.

Figure 5:
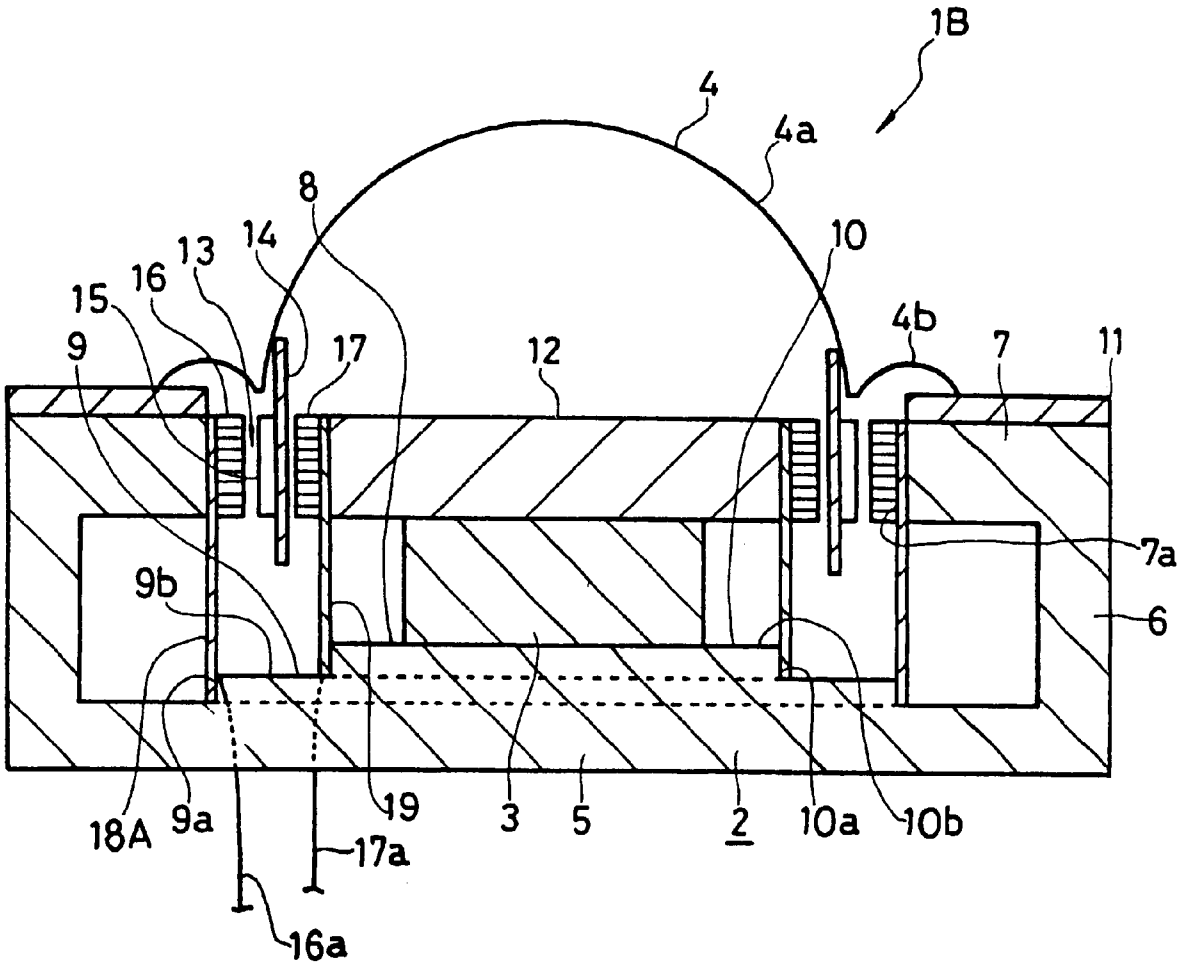
FIG. 5 is a schematic vertical sectional view showing an inner magnetic type electromagnetic induction speaker in which a first cylindrical member is directly fixed to an annular plate.

According to an inner magnetic type electromagnetic induction speaker 1B shown in FIG. 5, a first cylindrical member to which a primary coil on the outer peripheral side has been fixed is directly adhered to the annular plate 7.

As compared with the inner magnetic type electromagnetic induction speaker 1 shown in FIG. 3, the inner magnetic type electromagnetic induction speaker 1B shown below differs from the speaker 1 only with respect to a point that a first cylindrical member is directly adhered to an annular plate. In the description of the inner magnetic type electromagnetic induction speaker 1B, only different portions from those of the inner magnetic type electromagnetic induction speaker 1 will be described in detail. The other portions are designated by the same reference numerals as those shown in the similar portions in the inner magnetic type electromagnetic induction speaker 1 and their descriptions are omitted.

The outer peripheral side primary coil 16 is wound around an inner periphery of an upper edge portion of a first cylindrical member 18A having a thin cylindrical shape and fixed. The first cylindrical member 18A is formed so that its inner diameter is equal to the outer diameter of the first stairway portion 9. An inner surface of a lower edge portion of the first cylindrical member 18A is adhered to the first stairway surface 9*a* of the first stairway portion 9 of the positioning portion 8. An outer peripheral surface of the first cylindrical member 18A is adhered to the inner peripheral surface of the annular plate 7.

Generally, in case of directly adhering the primary coil to the inner surface of the annular plate, since the outer peripheral surface of the primary coil is not flat, after a flat surface is formed with an adhesive agent, it has to be adhered, so that it is very troublesome. There is a fear that when the cylindrical member is inserted into the yoke, the primary coil is come into contact with the inner surface of the annular plate and the primary coil is damaged.

However, like an inner magnetic type electromagnetic induction speaker 1B mentioned above, by adhering the outer peripheral side primary coil 16 to the annular plate 7 through the first cylindrical member 18A, the adhering operation becomes very easy and such a situation that the outer peripheral side primary coil 16 is come into contact with the annular plate 7 and damage occurs can be prevented.

Figure 6:
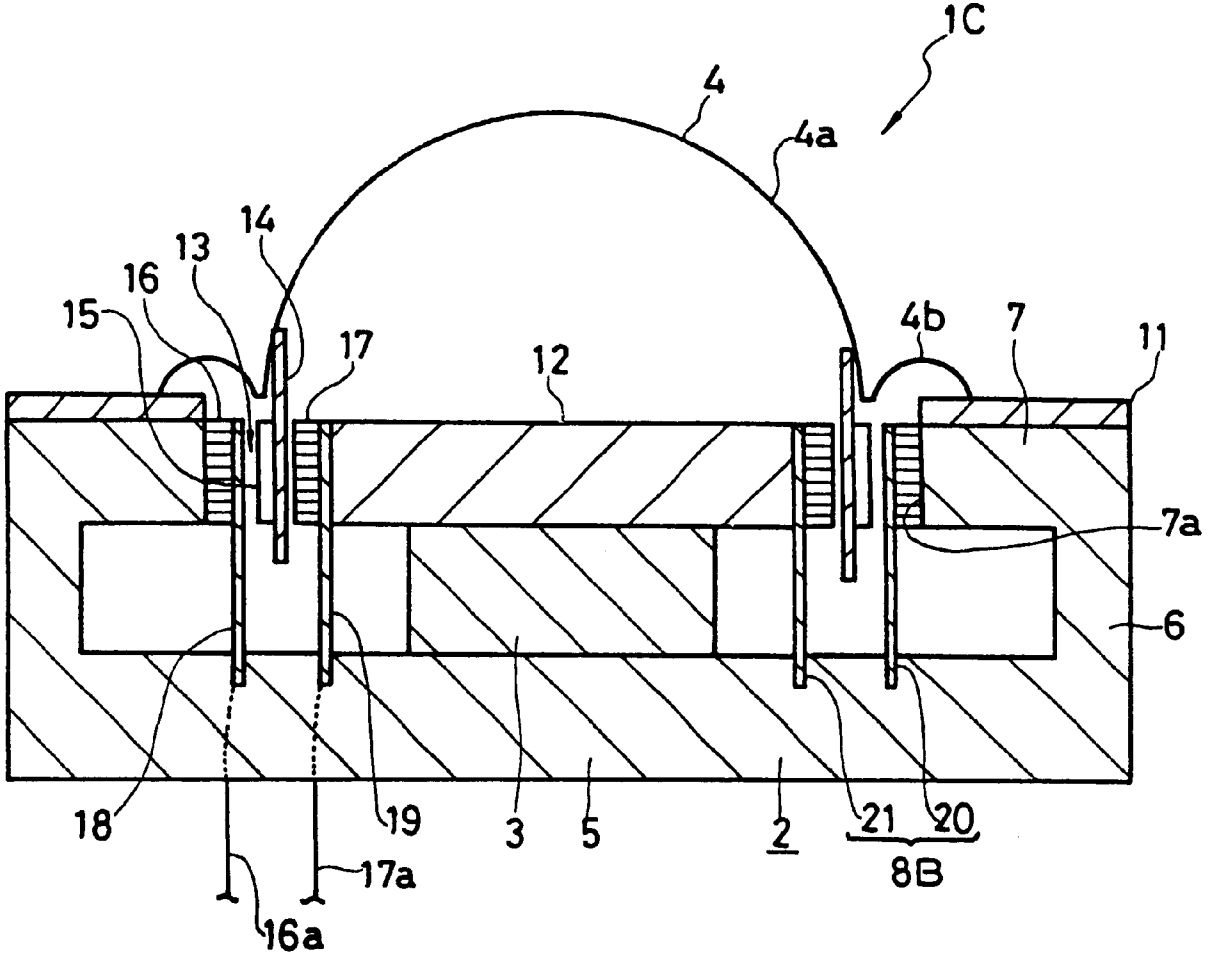
FIG. 6 is a schematic vertical sectional view showing an inner magnetic type electromagnetic induction speaker in which a positioning portion is formed as grooves.

According to an inner magnetic type electromagnetic induction speaker 1C shown in FIG. 6, a positioning portion is formed as an annular groove.

As compared with the inner magnetic type electromagnetic induction speaker 1 shown in FIG. 3, the following inner magnetic type electromagnetic induction speaker 1C differs from the speaker 1 with respect only to a point that a positioning portion is formed as an annular groove. In the description of the inner magnetic type electromagnetic induction speaker 1C, only different portions from those of the inner magnetic type electromagnetic induction speaker 1 will be described in detail. The other portions are designated by the same reference numerals as those shown in the similar portions in the inner magnetic type electromagnetic induction speaker 1 and their descriptions are omitted.

A positioning portion 8B comprises two annular grooves which are concentrically positioned and formed on the bottom portion 5, namely, a first groove 20 and a second groove 21 locating inside thereof.

The outer peripheral side primary coil 16 is wound around an outer periphery of an upper edge portion of the first cylindrical member 18 and fixed. The lower edge portion of the first cylindrical member 18 is fixed in the first groove 20 and the outer peripheral surface of the outer peripheral side primary coil 16 is adhered to the inner peripheral surface of the annular plate 7.

The outer peripheral side primary coil 16 fixed to the first cylindrical member 18 is fixed to the yoke 2, for example, by a method whereby the first cylindrical member 18 is inserted from the upper position into the yoke 2, the lower edge portion of the first cylindrical member 18 is fixed into the first groove 20, and the outer peripheral surface of the outer peripheral side primary coil 16 is adhered to the inner peripheral surface of the annular plate 7.

The inner peripheral side primary coil 17 is wound around an outer periphery of an upper edge portion of the second cylindrical member 19 and fixed. A lower edge portion of the second cylindrical member 19 is fixed in the second groove 21 and an inner peripheral surface of an upper edge portion of the second cylindrical member 19 is adhered to the outer peripheral surface of the center plate 12.

The inner peripheral side primary coil 17 fixed to the second cylindrical member 19 is fixed to the yoke 2, for example, by a method whereby the second cylindrical member 19 is preliminarily and externally fitted to the center plate 12, the inner surface of the upper edge portion of the second cylindrical member 19 is adhered to the center plate 12, and in a state where it has been fixed to the center plate 12, the second cylindrical member 19 is inserted into the yoke 2 together with the center plate 12 from the upper position of the yoke 2, and the lower edge portion is fixed into the second groove 21.

According to the foregoing positioning portion 8B, since it is sufficient to form the two grooves 20 and 21 onto the bottom portion 5 of the yoke 2, the positioning portion 8B can be extremely easily formed.

As for the inner magnetic type electromagnetic induction speaker 1C, since the first cylindrical member 18 and second cylindrical member 19 are fixed so as to be fitted into the first groove 20 and second groove 21, respectively, the attaching strength of the outer peripheral side primary coil 16 and inner peripheral side primary coil 17 can be further improved.

Figure 7:
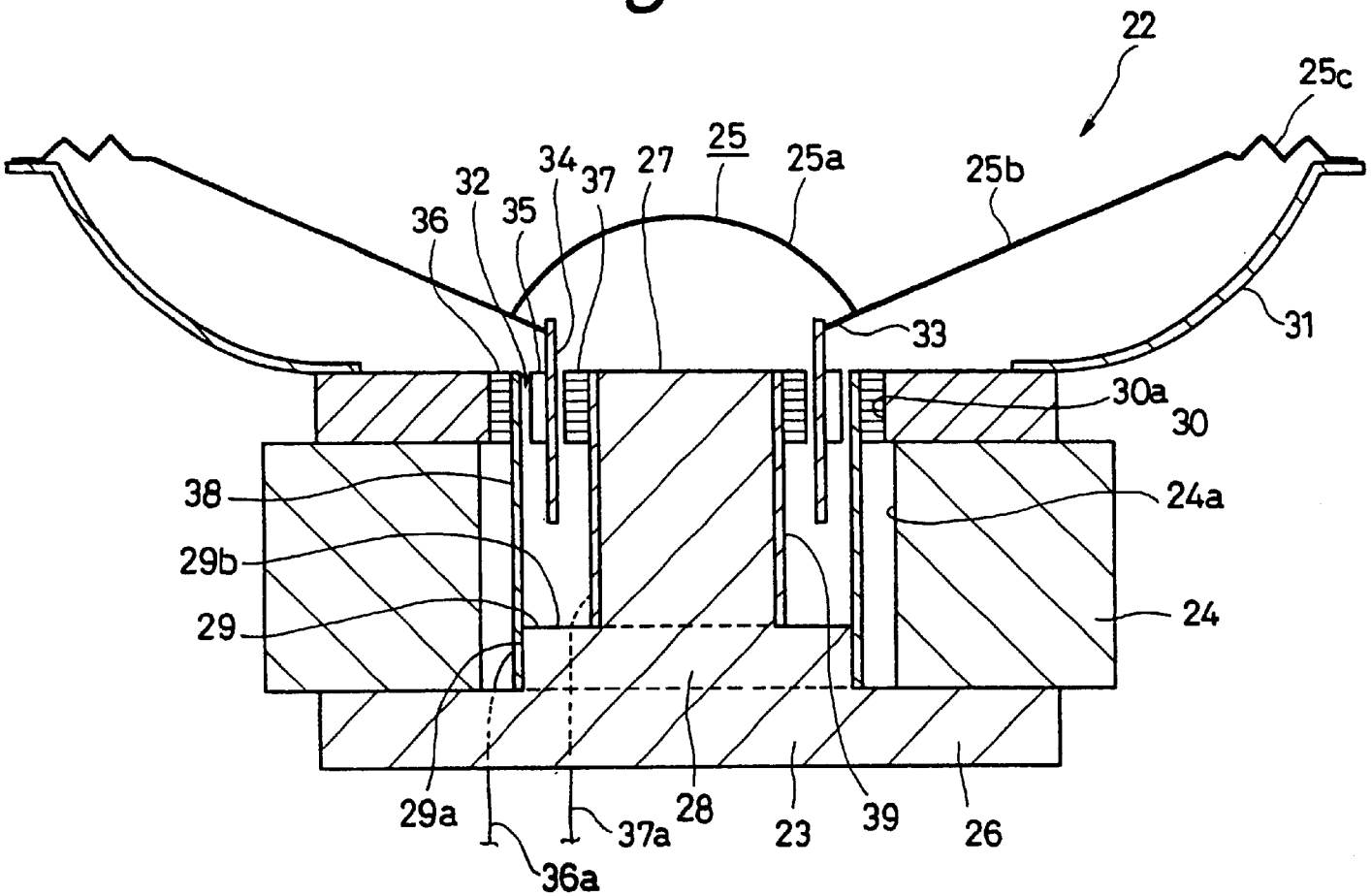
FIG. 7 is a schematic vertical sectional view showing the second embodiment in which the speaker apparatus of the invention is applied to an outer magnetic type electromagnetic induction speaker.

An outer magnetic type electromagnetic induction speaker 22 shown in FIG. 7 will now be described as a second embodiment.

The outer magnetic type electromagnetic induction speaker 22 comprises a yoke 23, a magnet 24, and a diaphragm 25.

The yoke 23 is constructed by integratedly forming a bottom portion 26 and a center pole 27 projecting upward from a center portion of the bottom portion 26. A positioning portion 28 is integratedly formed on an upper surface of the center portion of the bottom portion 26.

The positioning portion 28 is formed as a disk-shaped stairway portion 29. An outer peripheral surface 29*a* of the stairway portion 29 is formed as a stairway surface. An upper surface 29*b* is located slightly upward from the upper surface of the bottom portion 26. The center pole 27 is provided integratedly with a center portion of the upper surface 29*b* of the stairway portion 29.

The cylindrical magnet 24 is attached to an outer edge portion of the upper surface of the bottom portion 26. The magnet 24 is arranged, for example, coaxially with the stairway portion 29 and center pole 27 by being arranged in a positioning concave portion (not shown) formed on the upper surface of the bottom portion 26.

A ring-shaped annular plate 30 is attached to an upper surface of the magnet 24. The annular plate 30 is arranged in correspondence to an upper edge portion of the center pole 27. The upper edge portion of the center pole 27 is located in a center hole 30*a* of the annular plate 30. An outer edge upper surface of the annular plate 30 is attached to a frame 31. A gap formed between the annular plate 30 and center pole 27 becomes a magnetic gap 32. A magnetic circuit portion is constructed by the yoke 23, magnet 24, annular plate 30, and center pole 27.

An inner peripheral surface of the annular plate 30 is located slightly outside from the stairway surface 29*a* of the stairway portion 29, while a center axis of the stairway portion 29 of the positioning portion 28 is used as a reference.

The diaphragm 25 comprises: a center portion 25*a* which is located in the center portion and formed in an arc-shaped cross section; an inclined portion 25*b* which is provided so as to be continuous with an outer periphery of the center portion 25*a* and is deformed upward as it approaches outward; an edge portion 25*c* which is continuous with an outer periphery of the inclined portion 25*b;* and a fixing portion 33 which is provided so as to be continuous with an outer periphery of the center portion 25*a* and projected in the direction opposite to that of the inclined portion 25*b*. An outer edge portion of the edge portion 25*c* is attached to an upper surface of an outer edge portion of the frame 31. An upper edge portion of a cylindrical bobbin 34 is fixed to an edge portion of the fixing portion 33 by adhesion or the like.

A secondary coil 35 of one turn is wound around a portion near a lower edge of the bobbin 34 and fixed. The secondary coil 35 is located in the magnetic gap 32 formed between the annular plate 30 and center pole 27.

An outer peripheral side primary coil 36 and an inner peripheral side primary coil 37 are arranged in the magnetic gap 32 so as to face each other through the secondary coil 35. The outer peripheral side primary coil 36 is fixed to the inner peripheral surface of the annular plate 30. The inner peripheral side primary coil 37 is fixed to the upper edge portion of the outer peripheral surface of the center pole 27. The outer peripheral side primary coil 36 and inner peripheral side primary coil 37 are serially connected. One end of the outer peripheral side primary coil 36 and one end of the inner peripheral side primary coil 37 are connected to signal lead wires 36*a* and 37*a* to which an audio signal from an audio signal reproducing unit (not shown) is supplied, respectively.

The outer peripheral side primary coil 36 is wound around an outer periphery of an upper edge portion of a first cylindrical member 38 formed so as to have a thin cylindrical shape and fixed. The first cylindrical member 38 is formed so that its inner diameter is equal to the outer diameter of the stairway portion 29 of the positioning portion 28. An inner surface of a lower edge portion of the first cylindrical member 38 is adhered to the stairway surface 29*a* of the stairway portion 29. An outer peripheral surface of the outer peripheral side primary coil 36 fixed to the first cylindrical member 38 is adhered to the inner peripheral surface of the annular plate 30.

The outer peripheral side primary coil 36 fixed to the first cylindrical member 38 is fixed to the yoke 23, for example, by a method whereby the outer peripheral side primary coil 36 fixed to the first cylindrical member 38 is preliminarily adhered to the inner peripheral surface of the annular plate 30, and in a state where it has been fixed to the annular plate 30, the cylindrical member 38 is inserted into a center hole 24*a* of the magnet 24 from the upper position of the magnet 24 together with the annular plate 30, and a lower edge portion of the first cylindrical member 38 is adhered to the stairway surface 29*a* of the stairway portion 29 of the positioning portion 28. By externally fitting the first cylindrical member 38 to the stairway portion 29, the positioning of the outer peripheral side primary coil 36 to the yoke 2 is performed. Thus, the positioning of the annular plate 30 to the magnet 24 attached to the yoke 2 is also simultaneously performed. The annular plate 30 is fixed to the magnet 24 by using proper means such as adhesion, screwing, or the like.

The inner peripheral side primary coil 37 is wound around an outer peripheral of an upper edge portion of a second cylindrical member 39 having a thin cylindrical shape and fixed. The second cylindrical member 39 is formed so that its inner diameter is almost equal to the outer diameter of the center pole 27. The second cylindrical member 39 is adhered in a state where its inner surface is externally fitted to the center pole 27.

The inner peripheral side primary coil 37 fixed to the second cylindrical member 39 is fixed to the center pole 27 by, for example, externally fitting the second cylindrical member 39 to the center pole 26 and adhering it.

As mentioned above, in the outer magnetic type electromagnetic induction speaker 22, the positioning portion 28 is formed on the yoke 2 and the first cylindrical member 38 to which the outer peripheral side primary coil 36 is fixed and the second cylindrical member 39 to which the inner peripheral side primary coil 37 is fixed are merely externally fitted to the stairway portion 29 of the positioning portion 28 and the center pole 27 formed integratedly with the yoke 2, so that the positioning of the outer peripheral side primary coil 36 and inner peripheral side primary coil 37 to the yoke 2 can be performed.

Therefore, the positioning of the outer peripheral side primary coil 36 and inner peripheral side primary coil 37 to the yoke 2 can be extremely easily performed and there is no need to use the foregoing gap gauge which has conventionally been used, so that there is no fear of dropout from the yoke 2 or the like due to the contact of the gap gauge with the outer peripheral side primary coil 36 or inner peripheral side primary coil 37.

The first cylindrical member 38 is adhered to the stairway surface 29*a* of the positioning portion 28, the outer peripheral side primary coil 36 fixed to first cylindrical member 38 is adhered to the annular plate 30, and the second cylindrical member 39 is adhered to the center pole 27, so that an adhering area increases and an adhering strength of the outer peripheral side primary coil 36 and inner peripheral side primary coil 37 is improved.

As for the positioning portion 28, it is sufficient to merely form the stairway portion 29 on the bottom portion 26 of the yoke 2, so that the positioning portion 28 can be easily formed.

Although the foregoing positioning portion 28 is formed as a stairway portion 29 which is projected upward, the positioning portion can be also formed as a concave portion which opens upward, so that the first cylindrical member 38 is adhered to the peripheral surface of the concave portion. The positioning portion can be formed as an annular groove and the lower edge portion of the first cylindrical member 38 can be inserted and fixed into the groove.

Although the construction in which the outer peripheral side primary coil 36 and inner peripheral side primary coil 37 which face each other through the secondary coil 35 are arranged in the outer magnetic type electromagnetic induction speaker 22 has been shown, it is also possible to construct an outer magnetic type electromagnetic induction speaker in which a primary coil is arranged only on one of the outer peripheral side and the inner peripheral side of a secondary coil.

Although the outer magnetic type electromagnetic induction speaker 22 in which the outer peripheral side primary coil 36 is directly adhered to the annular plate 30 has been shown, the outer peripheral side primary coil can be fixed to the inner peripheral surface of the first cylindrical member and the upper edge portion of the inner peripheral surface of the first cylindrical member can be directly adhered to the annular plate 30.

The specific shape and structure of each portion shown in each of the above embodiments are shown as mere specific examples when the invention is embodied. The technical scope of the invention should not be limitedly interpreted by them.

As will be obvious from the above description, the speaker apparatus of the invention comprises: the bobbin fixed to the diaphragm; the yoke which forms the magnetic circuit together with the magnet and in which the positioning portion is formed; the primary coil which is arranged in the magnetic gap and to which the audio signal is inputted; and the secondary coil which is provided for the bobbin and arranged in the magnetic gap, wherein the apparatus has the cylindrical member in which the primary coil is fixed to one end portion and the other end portion is attached to the positioning portion of the yoke.

Therefore, since the positioning of the primary coil to the yoke can be extremely easily performed and there is no need to use the gap gauge, there is no fear of dropout from the yoke or the like due to the contact of the gap gauge with the primary coil.

The attaching area increases due to the direct attachment of the primary coil or the attachment thereof through the cylindrical member and the attaching strength can be improved.

According to the invention of Claim 2, the speaker apparatus comprises the annular plate having the center hole and the center member arranged inside of the annular plate, wherein the magnetic gap is formed between the annular plate and the center member and the primary coil is arranged between the annular plate and the secondary coil or between the center member and the secondary coil.

Even in case of the speaker apparatus in which the primary coil is arranged only on one side of the secondary coil, the positioning of the primary coil to the yoke can be extremely easily performed.

According to the invention of Claim 3, the speaker apparatus comprises the annular plate having the center hole and the center member arranged inside of the annular plate, wherein the magnetic gap is formed between the annular plate and the center member and the primary coil is fixed to the inner peripheral surface of the annular plate through the cylindrical member or fixed to the outer peripheral surface of the center member through the cylindrical member, so that the fixing operation becomes very easy and such a situation that the primary coil is come into contact with the annular plate or center member and damage occurs does not occur.

According to the invention of Claim 4, the speaker apparatus comprises the annular plate having the center hole and the center member arranged inside of the annular plate, wherein the magnetic gap is formed between the annular plate and the center member and the primary coil is arranged between the annular plate and the secondary coil and between the center member and the secondary coil, respectively.

Even in case of the speaker apparatus in which the primary coils are arranged so as to sandwich the secondary coil, the positioning of the primary coil to the yoke can be extremely easily performed.

According to the invention of Claim 5, since the positioning portion provided for the yoke is formed as a stairway portion, the positioning portion can be easily formed.

According to the invention of Claim 6, since the positioning portion provided for the yoke is formed as an annular groove, the positioning portion can be extremely easily formed.

Since the cylindrical member can be fixed by fitting it into the groove, the attaching strength of the primary coil can be further improved.

The construction in which the bobbin is adhered to the diaphragm has been described as an example in the foregoing embodiment. A detailed construction of the coupling portion of the diaphragm and the bobbin will now be described with reference to the following drawings. As a speaker which will be explained by using the following drawings, an inner magnetic type electromagnetic induction speaker will be described as an example. Although the inner magnetic type electromagnetic induction speaker will be described as an example with respect to the case where the secondary coil itself constructs a bobbin, the invention can be also applied to an inner magnetic type speaker of a type in which the secondary coil is attached to the bobbin shown in FIGS. 3 to 6.

Figure 8:
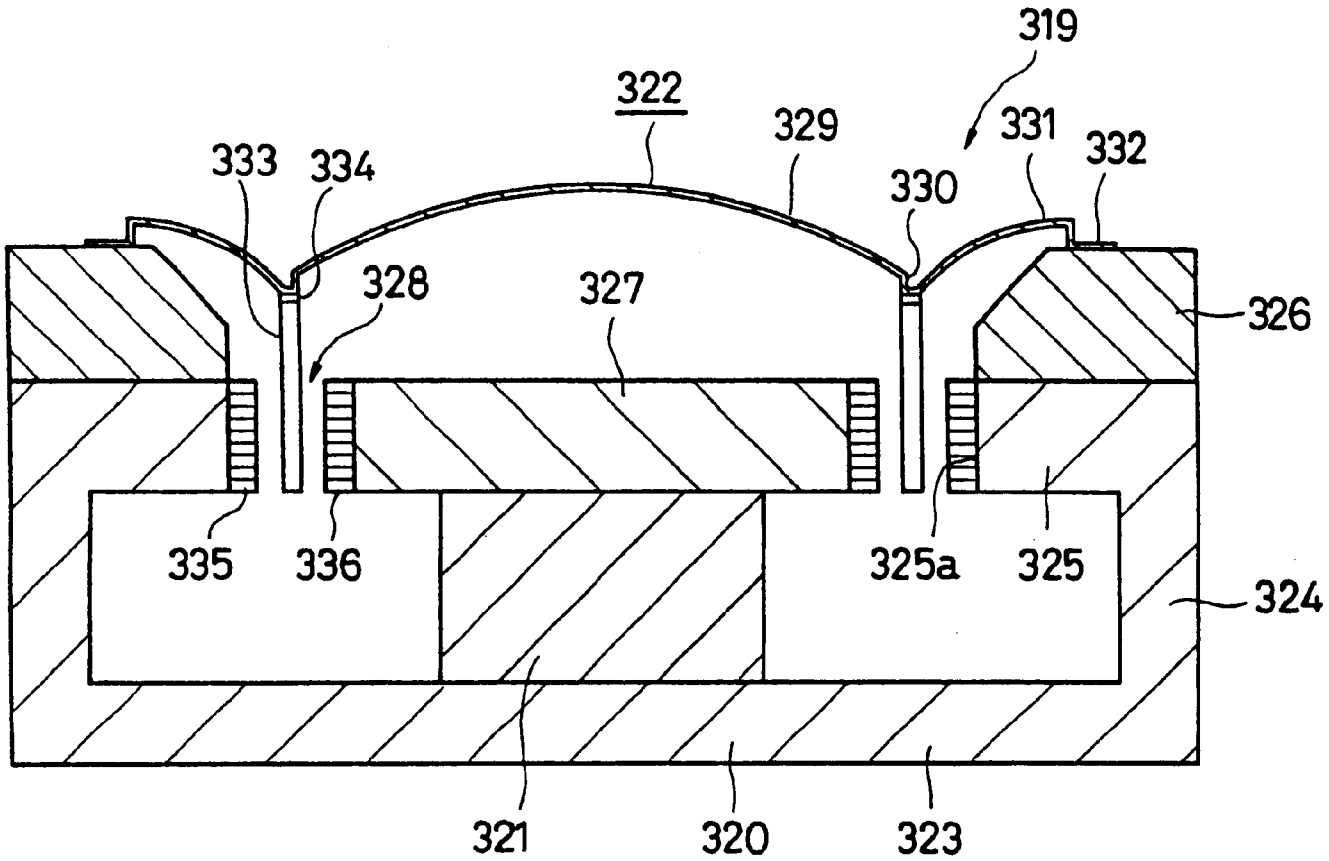
FIG. 8 shows the third embodiment in which the speaker apparatus of the invention is applied to a conducting type speaker apparatus in which a conductive ring is fixed to a diaphragm together with FIG. 9 and is a schematic vertical sectional view of the speaker apparatus.

A speaker apparatus 319 shown in FIGS. 8 and 9 in which a bobbin and a conductive ring serving as a secondary coil are directly fixed will be described.

The speaker apparatus 319 comprises a yoke 320, a magnet 321, and a diaphragm 322.

The yoke 320 is constructed by integratedly forming a disk-shaped bottom portion 323, a peripheral wall portion 324 projected upward from a peripheral edge of the bottom portion 323, and a ring-shaped annular plate 325 provided at an upper edge of the peripheral wall portion 324. The cylindrical magnet 321 is attached to a center portion of an upper surface of the bottom portion 323. As for the yoke 320, an upper surface of the annular plate 325 is attached to a frame 326.

A disk-shaped center plate 327 is attached to an upper surface of the magnet 321. The center plate 327 is arranged in a center hole 325*a* of the annular plate 325. A gap formed between the annular plate 325 and center plate 327 is a magnetic gap 328.

The diaphragm 322 is molded so that the whole portion is formed in an almost dome shape by press working a metal material, for example, a sheet-shaped material such as aluminum, titanium, or the like or a sheet-shaped material made of a high molecular material, or the like. The diaphragm 322 is constructed by integratedly forming: an almost semispherical dome portion 329 locating in a center portion; a coupling portion 330 which is continuous with an outer periphery of the dome portion 329; an edge portion 331 which is continuous with an outer periphery of the coupling portion 330 and has a small almost arc-shaped cross section; and a portion 332 which is to be attached and is continuous with an outer periphery of the edge portion 331. The portion 332 to be attached is attached to an upper surface of the frame 326.

The coupling portion 330 comprises: an inner peripheral portion 330*a* which is located on the dome portion 329 side and is extended in the vertical direction; and a flat surface portion 330*b* which is continuous with a lower edge of the inner peripheral portion 330*a* and faces in the vertical direction. As for the diaphragm 322, the flat surface portion 330*b* of the coupling portion 330 for coupling the dome portion 329 and edge portion 331 is particularly thinly formed because it is stretched in both directions at the time of a pressing work. An upper edge portion of a cylindrical conductive ring 333 is fixed to a lower surface of the flat surface portion 330*b* by, for example, an adhesive agent 334 of an epoxy resin system.

The bobbin and the conductive ring 333 serving as a secondary coil are formed fairly thickly than the bobbin 14 in the speaker apparatus 1 mentioned above in order to reduce their electrical resistances. The conductive ring 333 is formed so that its thickness is equal to a width of flat surface portion 330*b* of the diaphragm 322.

The adhesive agent 334 is coated onto the whole lower surface of the flat surface portion 330*b*. An upper edge surface of the conductive ring 333 is adhered to the flat surface portion 330*b* through the adhesive agent 334. An almost lower half portion of the conductive ring 333 is located in the magnetic gap 328 formed between the annular plate 325 and center plate 327.

An outer peripheral side coil 335 and an inner peripheral side coil 336 are arranged in the magnetic gap 328 so as to face each other through the conductive ring 333. The outer peripheral side coil 335 is adhered to an inner peripheral surface of the annular plate 325. The inner peripheral side coil 336 is adhered to an outer peripheral surface of the center plate 327. The outer peripheral side coil 335 and inner peripheral side coil 336 are serially connected. One end of the outer peripheral side coil 335 and one end of the inner peripheral side coil 336 are connected to signal lead wires (not shown) to which an audio signal from an audio signal reproducing unit (not shown) is supplied, respectively.

When a current based on the audio signal from the audio signal reproducing unit (not shown) is supplied to the outer peripheral side coil 335 and inner peripheral side coil 336 through the signal lead wires (not shown), an induction current flows in the conductive ring 333 arranged in the magnetic gap 328 and the diaphragm 322 vibrates. Au audible sound based on the audio signal supplied from the audio signal reproducing unit is generated.

In the foregoing speaker apparatus 319, since the adhesive agent 334 has been coated to the flat surface portion 330*b* formed particularly thinly, the substantial thickness of the flat surface portion 330*b* increases and the mechanical strength of the flat surface portion 330*b* is enhanced.

Therefore, since vibrations whose phases are deviated by 180° do not occur at a specific frequency in the dome portion 329 and edge portion 331, while the flat surface portion 330*b* is used as a node, a dip of a sound pressure is not caused. Thus, since good frequency characteristics are obtained, a quality of an audio signal to be generated can be improved.

As mentioned above, since the adhesive agent 334 has been coated on the whole lower surface of the flat surface portion 330*b*, the mechanical strength of the flat surface portion 330*b* is very large and a quality of the audio signal to be generated can be further improved.

By forming in such a manner that the width of flat surface portion 330*b* is equal to the thickness of conductive ring 333 adhered to the flat surface portion 330*b* as mentioned above, the mechanical strength of the flat surface portion 330*b* is very large.

Figure 9:
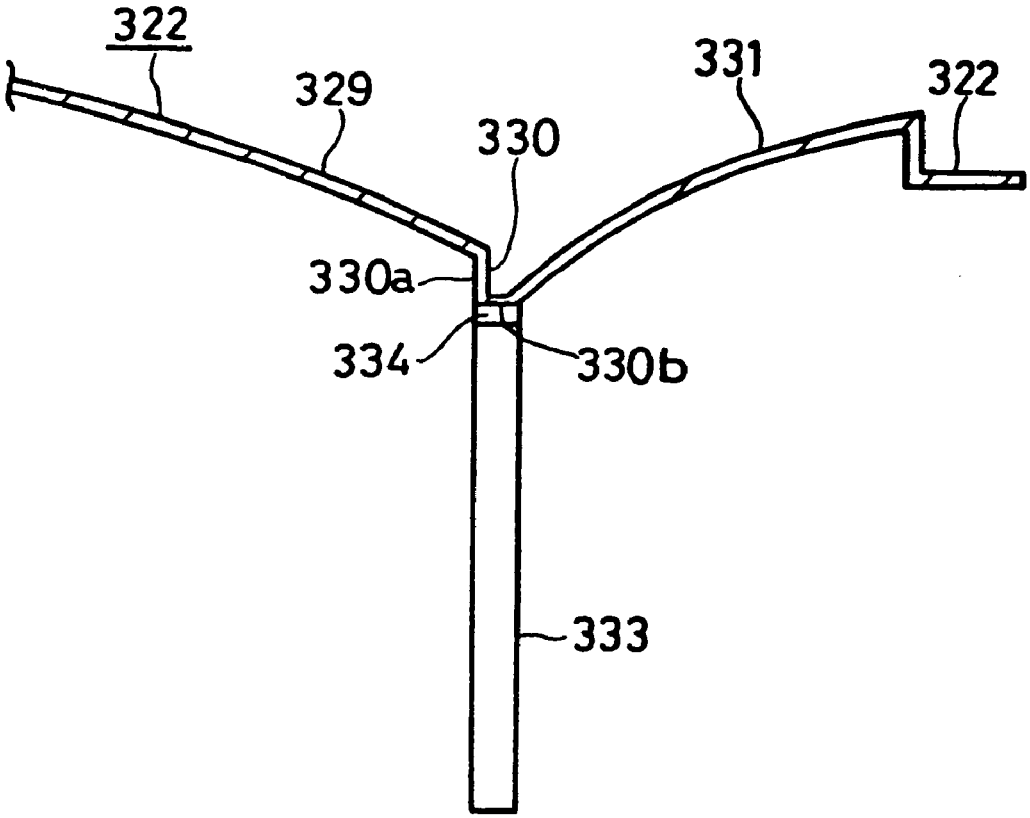
FIG. 9 is an enlarged vertical sectional view of a main portion.
Figure 10:
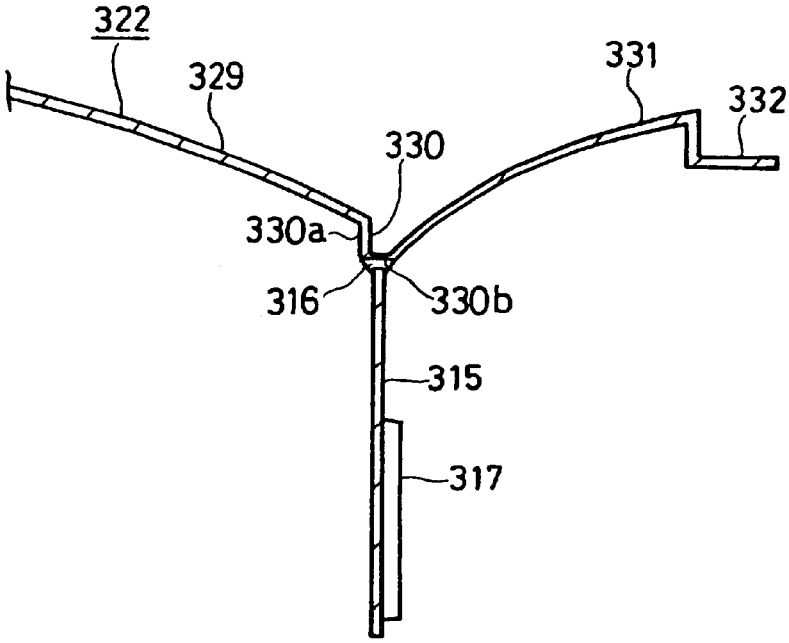
FIG. 10 is an enlarged vertical sectional view of a main portion of a speaker apparatus in which a bobbin is fixed to a diaphragm.
Figure 11:
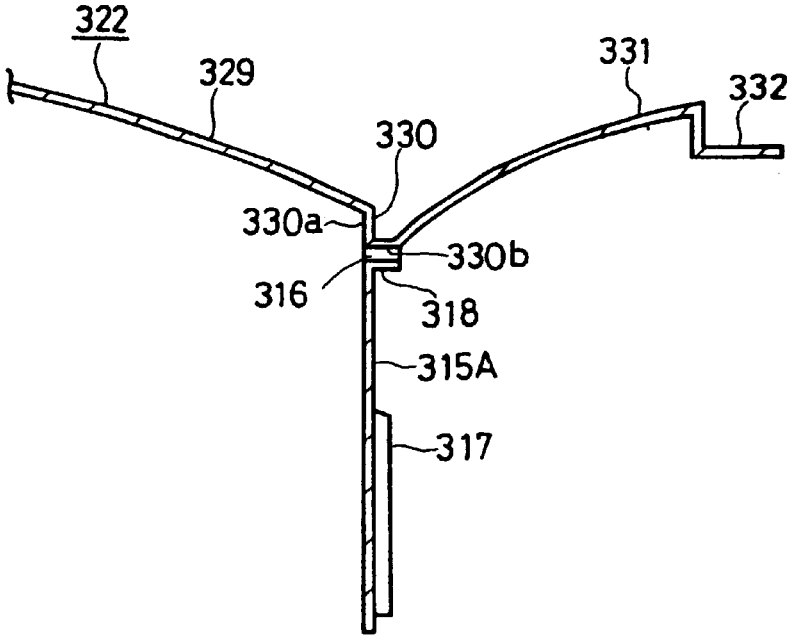
FIG. 11 is an enlarged vertical sectional view of a main portion of a speaker apparatus in which a bobbin formed with a bending portion is fixed to a diaphragm.

The invention is not limited to the construction shown in FIG. 9 but can be applied to a speaker apparatus as shown in, for example, FIG. 10 or 11. Although a construction of only a coupling portion of a diaphragm and a bobbin is shown in each of FIGS. 10 and 11, a construction of the other portions of the speaker apparatus is similar to that of the speaker apparatus shown in FIG. 9. Portions common to those in FIG. 9 are designated by the same reference numerals and their detailed descriptions are omitted.

In the speaker apparatus shown in FIG. 10, a secondary coil 317 of one turn made of a conductive material is wound around or fixed to a bobbin 315 made of an insulative material. The bobbin 315 is cylindrically formed, one end side is adhered to the lower surface 330*b* of the flat surface portion 330, and the other end side is inserted into the magnetic gap 328 so that the secondary coil 317 faces the primary coils 335 and 336. An adhesive agent 316 is coated onto the lower surface 330*b* of the flat surface portion 330 of the diaphragm 322 so that its cross sectional shape becomes a handstand triangular shape, thereby allowing the bobbin 315 to be fixed to the flat surface portion 330 of the diaphragm 322.

In the speaker apparatus shown in FIG. 11, the secondary coil 317 is wound around or fixed to a bobbin 315A in a manner similar to the speaker apparatus shown in FIG. 10 mentioned above. The bobbin 315A is cylindrically formed by using aluminum, titanium, or the like and has a bending portion 318 whose one end side is bent to the outside at a right angle. The adhesive agent 316 is coated to one surface of the bending portion 318 or the lower surface 330*b* of the flat surface portion 330. One end side of the bobbin 315A, namely, the bending portion 318 is fixed to the flat surface portion 330*b* of the diaphragm 322.

The invention is not limited to each of the foregoing embodiments but many various modifications and variations are possible within the scope of the invention without largely departing from the spirit of the invention.

What is claimed is:

1. A speaker apparatus comprising:

a magnetic circuit portion having a magnet, a yoke on which said magnet is provided, and a top plate for forming a magnetic gap together with said yoke;

at least one primary coil arranged in the magnetic gap of said magnetic circuit portion;

a diaphragm;

a secondary coil provided for said diaphragm so as to face said primary coil in said magnetic gap;

a cylindrical member in which one side located in said magnetic gap is attached to said primary coil; and a positioning portion, provided in said yoke, for positioning the other side of said cylindrical member, wherein said positioning portion is a stairway portion provided in said yoke.

2. An apparatus according to claim 1, wherein said one side of said cylindrical member is arranged between said primary coil and said magnetic circuit portion.

3. An apparatus according to claim 1, wherein said diaphragm comprises: a diaphragm portion formed almost in a dome shape; an edge portion provided on an outer peripheral side of said diaphragm portion; and a flat portion provided between said diaphragm portion and said edge portion, and said secondary coil is arranged on said flat portion.

4. An apparatus according to claim 3, wherein one end side of said secondary coil is attached to said flat portion.

5. An apparatus according to claim 3, further comprising a bobbin for which said secondary coil is provided and whose one end is attached to said flat portion of said diaphragm.

6. An apparatus according to claim 5, wherein a bending portion is formed on one end side of said bobbin and said bending portion is adhered to said flat portion of said diaphragm.

7. A speaker apparatus comprising:

a magnetic circuit portion having a magnet, a yoke on which said magnet is provided, and a top plate for forming a magnetic gap together with said yoke;

a first primary coil arranged in the magnetic gap of said magnetic circuit portion;

a diaphragm;

a secondary coil provided for said diaphragm so as to face said primary coil in said magnetic gap;

a first cylindrical member in which one side located in said magnetic gap is attached to said first primary coil;

a positioning portion, provided for said yoke, for positioning the other side of said cylindrical member;

a second primary coil which is arranged in said magnetic gap of said magnetic circuit portion so as to face said first primary coil through said secondary coil; and a second cylindrical member in which said second primary coil is attached to one side located in said magnetic gap, wherein the other side of said second cylindrical member is positioned by said positioning portion, and said first primary coil and said second primary coil are serially connected.

8. An apparatus according to claim 7, wherein said positioning portion is constructed by: a first stairway portion for positioning the other side of said cylindrical member formed on said yoke; and a second stairway portion for positioning the other side of said another cylindrical member.

9. An apparatus according to claim 8, wherein said first positioning portion and said second positioning portion are formed in a bottom portion of said yoke so as to have a stairway shape.

10. An apparatus according to claim 7, wherein said positioning portion is constructed by: a first groove portion for positioning the other side of said cylindrical member formed on said yoke; and a second groove portion for positioning the other side of said another cylindrical member.

11. An apparatus according to claim 7, wherein said another primary coil is provided at a position where it faces said primary coil of said yoke, and said another cylindrical member is arranged so as to face said secondary coil in said magnetic gap.

12. An apparatus according to claim 7, wherein said one side of said another cylindrical member is arranged between said another primary coil and said magnetic circuit portion.

* * * * *